US008074588B2

(12) United States Patent
Guerreschi

(10) Patent No.: US 8,074,588 B2
(45) Date of Patent: Dec. 13, 2011

(54) SEWING MACHINE

(75) Inventor: Carlo Guerreschi, Cadidavid (IT)

(73) Assignee: Vi.Be.Mac. S.p.A., Verona (IT)

( * ) Notice: Subject to any disclaimer, the term of this patent is extended or adjusted under 35 U.S.C. 154(b) by 290 days.

(21) Appl. No.: 12/494,807

(22) Filed: Jun. 30, 2009

(65) Prior Publication Data

US 2010/0000452 A1 Jan. 7, 2010

(30) Foreign Application Priority Data

Jul. 4, 2008 (IT) ..... VR2008A0078

(51) Int. Cl.
*D05B 1/08* (2006.01)

(52) U.S. Cl. ..... 112/163

(58) Field of Classification Search ..... 112/163, 112/116, 220, 221, 222, 234, 235, 237
See application file for complete search history.

(56) References Cited

U.S. PATENT DOCUMENTS 1,244,115 A * 10/1917 Merrow ..... 112/319
3,783,811 A 1/1974 Schmedding et al.
3,875,878 A * 4/1975 Kaminski ..... 112/116
4,043,283 A 8/1977 Jung
5,474,001 A * 12/1995 Tajima et al. ..... 112/102.5
5,694,872 A * 12/1997 Zeller ..... 112/235

FOREIGN PATENT DOCUMENTS

| | | |
|---|---|---|
| EP | 0 353 208 | 1/1990 |
| GB | 2 027 074 | 2/1980 |
| GB | 2 160 236 | 12/1985 |

* cited by examiner

*Primary Examiner* — Tejash Patel

(74) *Attorney, Agent, or Firm* — Notaro, Michalos & Zaccaria P.C.

(57) ABSTRACT

Sewing machine (10 comprising a base (12) with a crochet and a head (14) that comprises a needle support (30), a fabric pressure foot (24) and its adjusting means (26), motor means (28) to make a needle sew together with the crochet, and lever means (32) to turn the rotary motion of the driving means into a vertical reciprocating motion. The needle support (30) in turn comprises at least two needle bars (46, 48) that are moved vertically by said lever means (32), and a connecting element (50) to couple the lever means (32) with at least a needle bar (46,48). Each needle bar (46,48) is coupled with a needle (16,18) through a respective thread and actuated selectively in the crochet in order to allow the sewing.

10 Claims, 8 Drawing Sheets

SEWING MACHINE

The present invention refers to a sewing machine and preferably an industrial sewing machine that is suited to mechanically sew two or more pieces of fabric with two or more seams having different characteristics.

The structure of this sewing machine is simple. In addition, this sewing machine can sew two pieces of fabric by utilizing two threads having different characteristics such as colour, thickness, etc.

As is known, the industrial sewing machines that sew mechanically two or more pieces of fabric are usually conceived according to different construction techniques that depend on the several operations to be performed.

For instance, units comprising one or more needles are known to sew articles of clothing such as jeans or causal trousers in general, working clothes and shirts and so on.

In the more common form, said versions are provided with an upper head on which the needle is positioned, a fabric feeding system to feed the pieces of fabric to be sewn and a base that is positioned under the upper head and comprises means cooperating with the need for the formation of the stitch.

In the upper head, the rotary motion imparted by a shaft connected with the driving motor is turned into a reciprocating motion by an eccentric and transferred to the needle support. In addition, the upper head is provided with a fabric pressure foot near the needle, which pressure foot presses the pieces of fabric to be sewn toward the base.

The fabric feeding system usually comprises suitable means that act on the pieces to be sewn by translating them according to a direction.

The base is positioned under the upper head and comprises at least a crochet that permits to complete the seam stitches together with the needle.

Obviously, all the described components that can perform rotary and translatory motions are moved in synchronism.

The industrial sewing machines must meet the requirements of stylists and designers who design articles of clothing with more and more exclusive features. A particular need is to obtain articles of clothing sewn by utilizing different sewing types and threads, for instance of different colours.

The known systems to effect seams of different colours on an article of clothing are alternatively the following. It is possible at first, to utilize an only single-needle sewing machine to obtain a seam of a certain colour and then, to replace the first thread with another thread of a different colour to obtain a second seam of a different colour.

Alternatively, it is possible to utilize two single-needle sewing machines utilizing threads showing different characteristics in order to effect a type of seam with the first sewing machine and a seam of a different type with the second sewing machine.

A further alternative is represented by the utilization of an only multi-needle sewing machine.

Each of said systems is disadvantageous: in the first two systems, the sewing times are too long and in the third system, it is necessary to utilize a sewing machine having at least two needles and two crochets, which correspond and are fixed.

The aim of this invention is to remove said disadvantages and further disadvantages by carrying out an only automatic sewing machine showing a simple structure to sew for instance, vamps, patch pockets, jeans and any article for which it is necessary to utilize more sewing threads having different characteristics.

All said aims and advantages are achieved according to this invention by a sewing machine comprising a base with a crochet and a head that comprises the following components a needle support, a fabric pressure foot and its adjusting means, driving means to make a needle sew together with the crochet, and lever means to turn the rotary motion of the motor means into a vertical reciprocating motion. The needle support in turn comprises at least two needle bars that are moved vertically by said lever means, and a connecting element to couple the lever means with at lead a needle bar. Each needle bar is coupled with a needle through a respective thread and is actuated selectively in the crochet in order to allow the sewing.

As an advantage, translatory means are provided for the translation of the needle support in a direction that is orthogonal to the vertical movement of the needle bars so that the needle support can translate and brings one of the needle bars operated selectively to the crochet in order to effect the sewing.

Advantageously, the machine according to this invention permits to effect, in two or more separate phases, at least two seams of different type, namely, two or more seams, each seam being effected by utilizing a thread with different characteristics, for instance a different colour. The structure of the machine is simple since it is provided with an only crochet in which the needle of one of two or more needle bars effects the seam although it comprises two or more translating needle bars and relative translating device.

Advantageously, the machine according to this invention may comprise blocking means to block one or more of the non-operating needle bars in order to permit a vertical reciprocating movement of an only needle bar.

Advantageously, the machine may comprise an only thread tension element in which at least two holes are provided and a thread passes through each of said holes.

Each needle bar may comprise a thread locking means so that when a needle bar is not operating, it is avoided that the thread goes out of the need owing to the movement of the tension element.

Further features and details of the invention will be better understood from the following specification that is provided as a non-limiting example as well as from the accompanying drawings, wherein.

Figure 1:
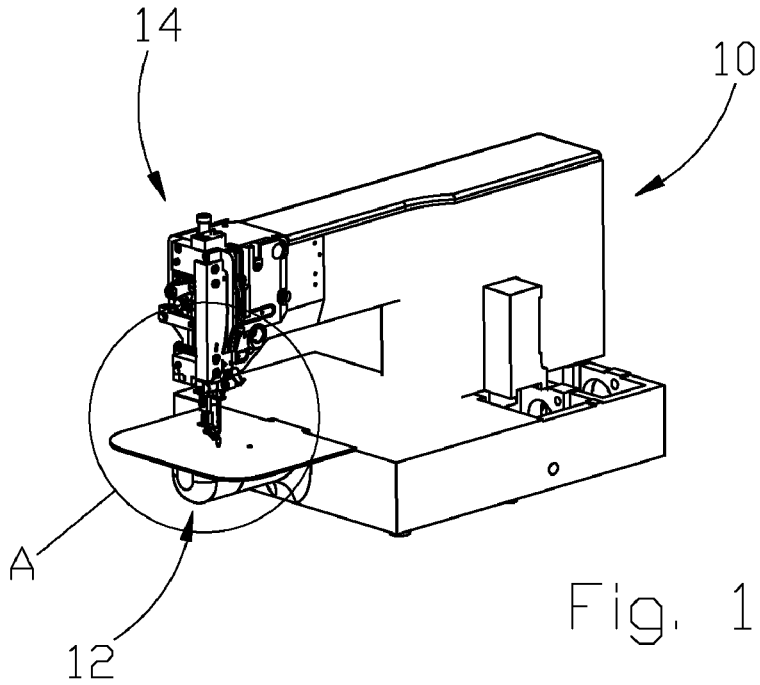
FIG. 1 is an axonometric top view of a sewing machine according to this invention.
Figure 2:
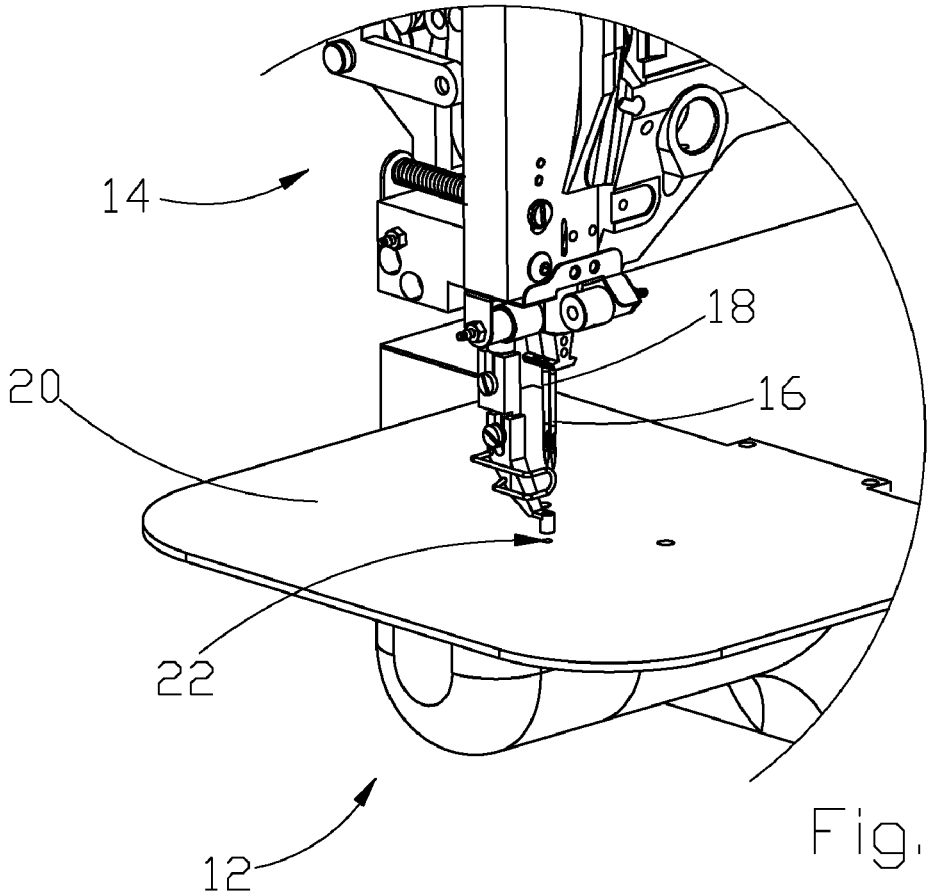
FIG. 2 shows a detail indicated with A in FIG. 1.

With reference to the accompanying drawings, in particular FIGS. 1, 2, number 10 denotes a sewing machine comprising a head 14 and a base 12. The base 12 has a plane 20 on which the pieces of fabric to sew are positioned. In the plane 20, a hole 22 is obtained to insert a needle which effect a seam in cooperation with a crochet (not visible in the figures) which is arranged under the plane 20.

Figure 3:
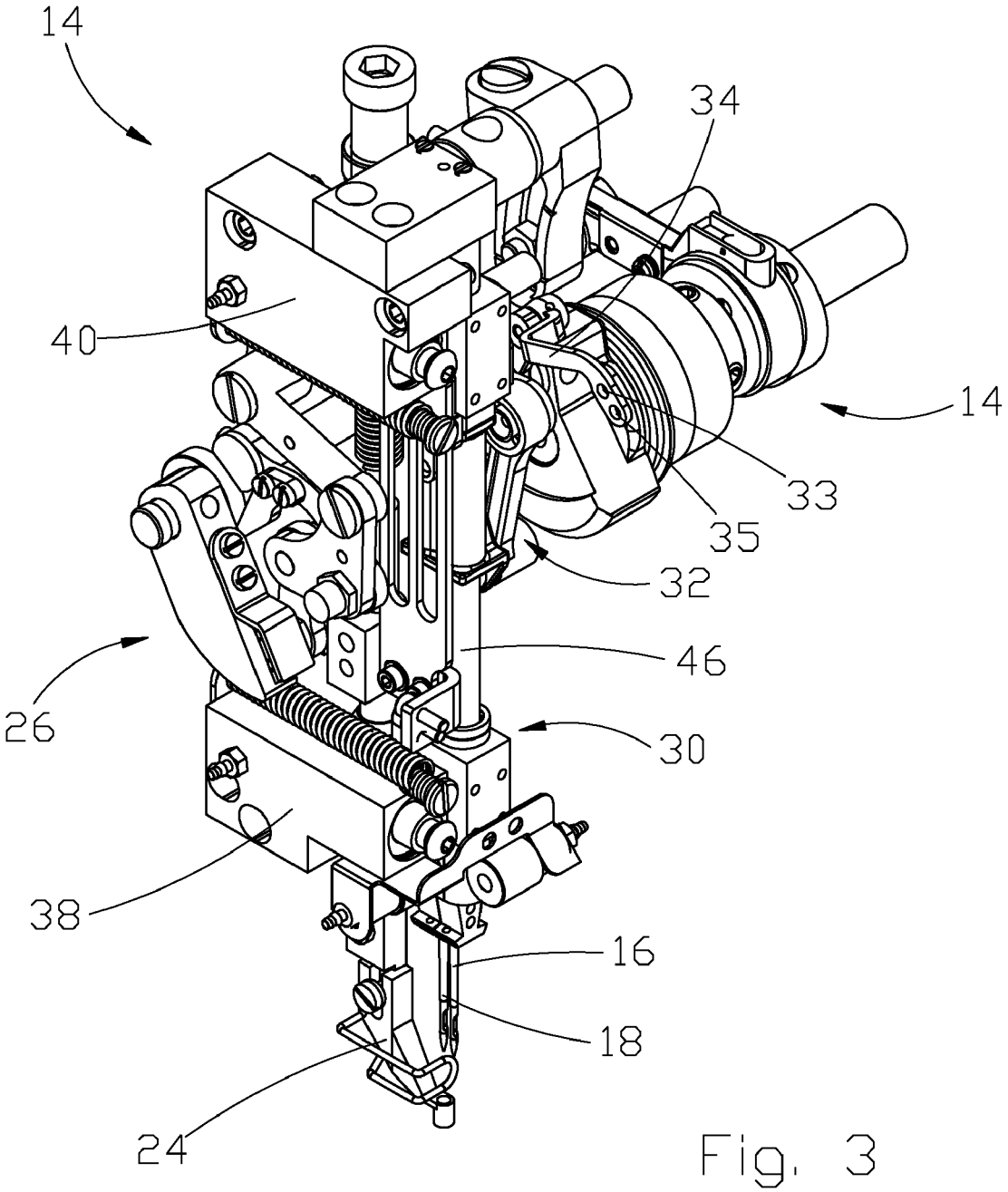
FIG. 3 is an axonometric view from the inside of the head of the sewing machine of FIG. 1.

The head 14 as represented in FIG. 3 comprises:

- A fabric pressure foot 24. Its position is controlled by adjusting means 26;
- A needle support 30 comprising two vertically moveable cylindrical elements, called needle bars thereafter, to which two needles 16, 18 (in FIG. 3, only a needle bar 46 is visible);
- Translating means 38, 40 to translate said needle bars according to an orthogonal direction to the movement of the needle bars;
- Driving means 28 to drive the needle support 30;
- A leverage 32 to turn the rotary motion of the motor means 28 into a reciprocating motion to be transferred to the needle bar 30;
- A thread tension element 34 has two holes 33, 35 and through each of them a thread passes for a respective needle 16, 18.

The fabric pressure foot 24 and the relative adjusting means 26, the motor means 28 and the leverage 32 are not described further since all fall under the known art.

Figure 5:
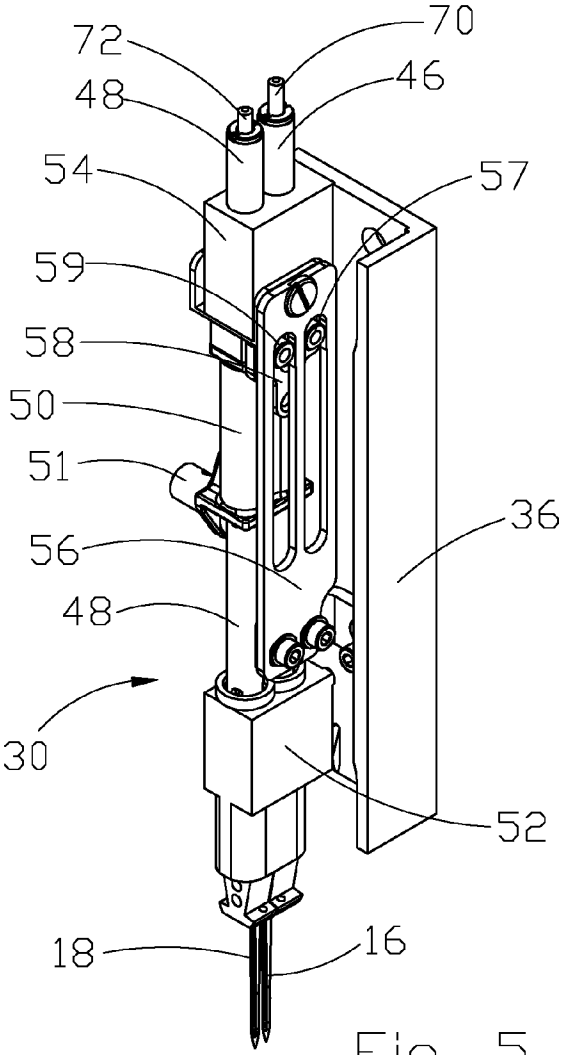
FIGS. 4, 5 are axonometric views according two different angulations of the needle support included in the head of FIG. 3.
Figure 4:
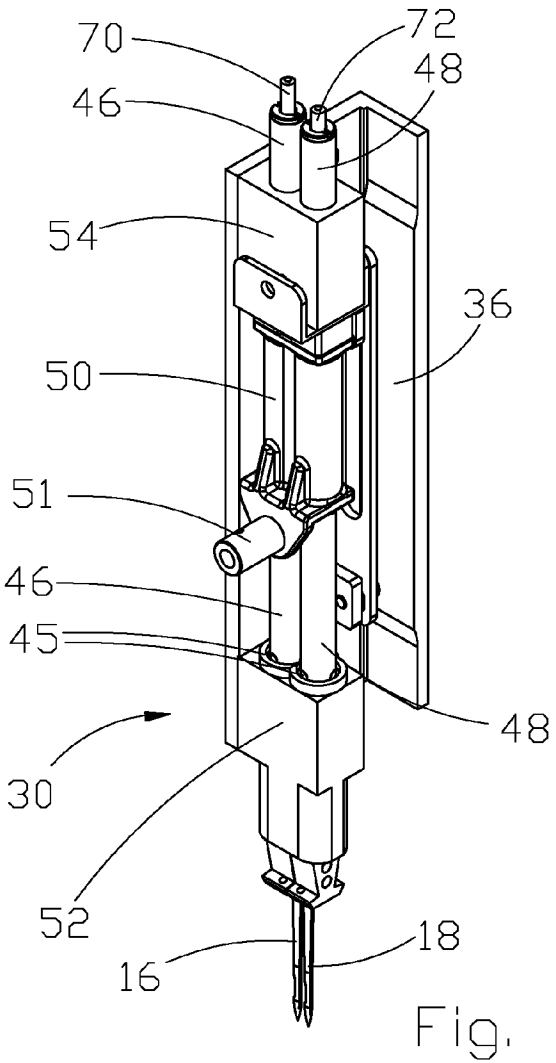

The needle support 30 as represented better in FIGS. 4, 5 comprises an L-shaped support frame 36 to which a lower guide support 52 and an upper guide support 54 are fixed. Two through holes are obtained in each of said guide supports 52, 54. In particular, the holes of the guide support 52 are coaxial to the holes of the guide support 54; each pair of coaxial holes receives a needle bar and therefore, the needle support 30 comprises two needle bars 46, 48.

A vertical reciprocating motion of the needle bars is obtained through a connecting element 50 which embraces the two needle bars 46, 48 to selectively lock them by means of a locking mechanism and to connect them through a pin 51 to a lever mechanism 32.

In particular, each needle bar 46, 48 comprises a first group of balls and a second group of balls, the second group of balls being arranged under the first group of balls.

The locking mechanism, which is selective of each bar 46, 48 in respect to the connecting element 50, provides that the first group of balls (not visible in the figures), subjected to pressure, goes out of one of the two bars and stops in position on beating on the inner surface of the connecting element 50 in order to lock it in respect to the bar that moves vertically with reciprocating motion.

Analogously, the second group of balls, indicated with 45 in FIGS. 4, 5, subjected to pressure, goes out of one of the two bars so that said bar is prevented from any vertical movement in respect to the needle support 30 and remains fixed and firm to the head 14 of the sewing machine.

The needle bars are made in such a way that when the first group of balls goes out of its position, the second group of balls comes back in the inside of the bar.

Figure 10:
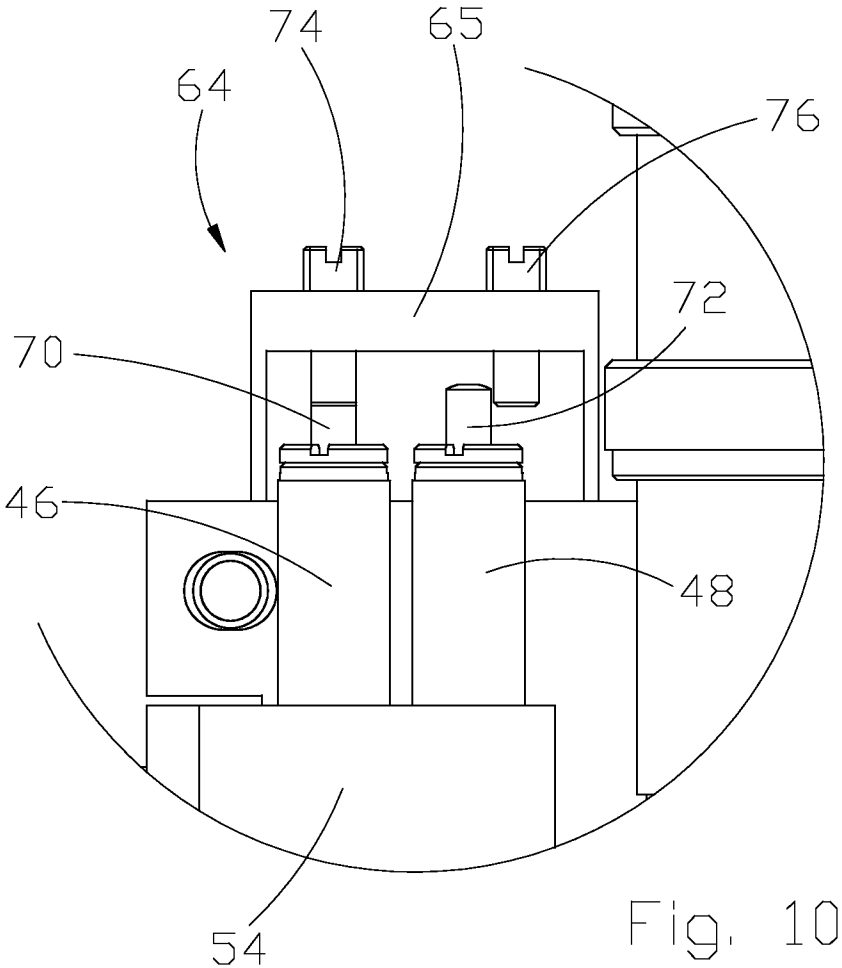
FIG. 10 shows a detail indicated with B in FIG. 9.
Figure 9:
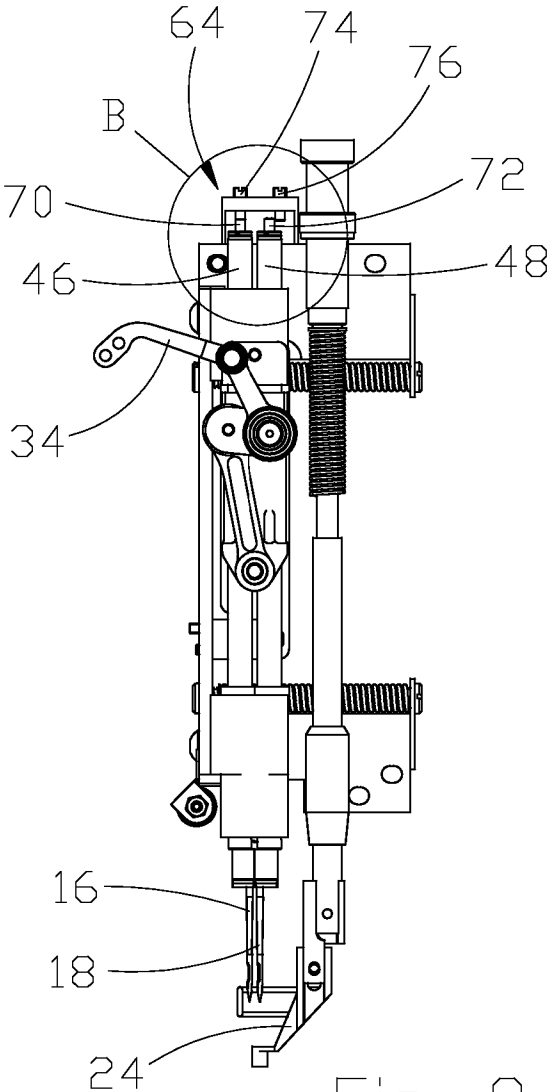
FIG. 9 is a side view of the translating means and needle support including a selecting mechanism to select the needle bar to utilize.

In synchronism, through a selective element 64 as represented in FIGS. 9 and 10 and described thereafter, the first group of balls goes out of a first needle bar and locks the same bar to the connecting element 50 and the second group of balls comes back in, while the first group of balls of the second needle bar (not subjected to any pressure) can come back in and allows that the same bar is released from the element 50. At the same time, the second group of balls 45 of the bar released from the element 50 goes out and lock the same released bar to the needle support 30.

In this way, only one needle bar remains constrained to the element 50 and translates vertically while the other remains fixed and firm to the head 14 of the sewing machine 10.

The connecting element 50 comprises a body 58. Two pips 57, 59 (FIG. 5) are fixed to the ends of the body 58 and slide in guides or slots obtained in a guide element 56 fixed to the support frame 36 and support guide 54. The vertical linear translation of both needle bars 46, 48 is further guaranteed by said guide element 56.

The lower end of each needle bar 46, 48 is fixed to a respective needle 16, 18 while the upper end comprises a respective pin 70, 72 that adjusts the inner pressure of each needle bar to permit the coming out of the first or second group of locking balls through the selecting element 64.

Figure 8:
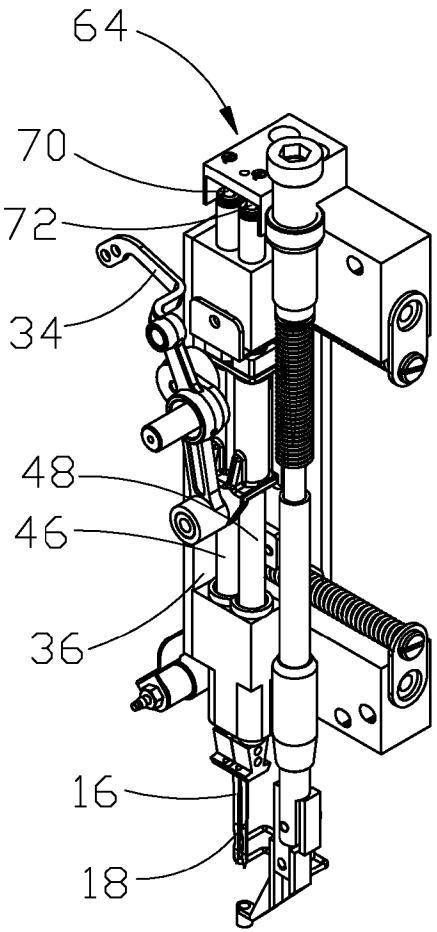
FIGS. 6, 7, 8 show the needle support of FIGS. 4, 5 coupled with the translating means for the choice of the needle bar to utilize.
Figure 7:
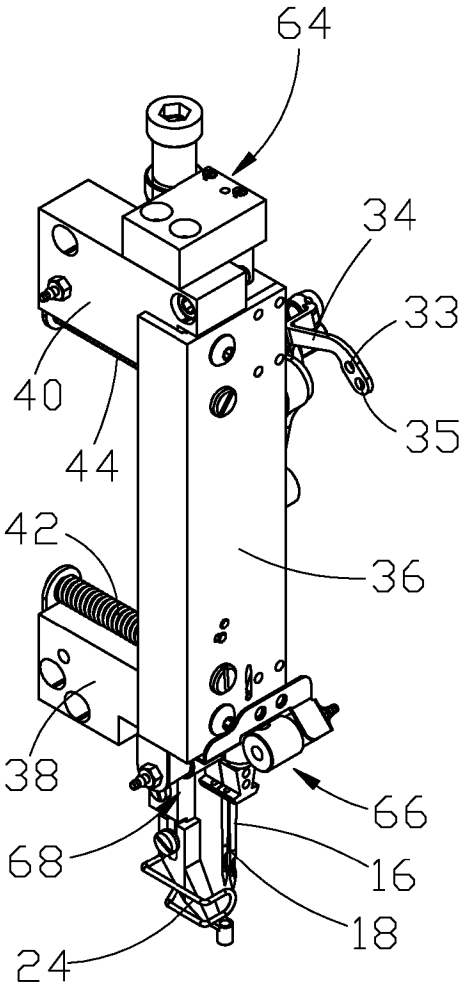
Figure 6:
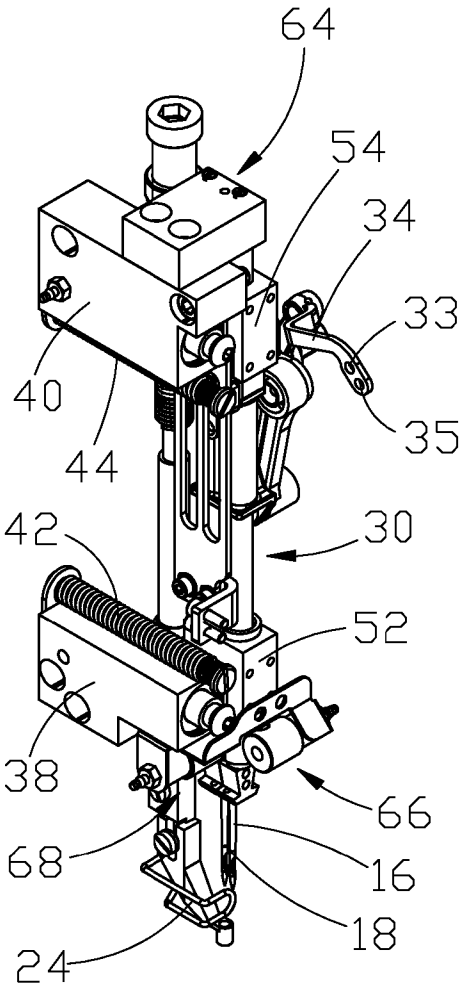

The connection and movement of the needle support 30 relative to the remaining part of the machine body 10 is obtained through a lower translating means 38 and an upper translating means 40. Each translating means is respectively fixed to the support frame 36 as it appears in FIG. 7. In FIG. 8, the frame 36 is not represented to better see the inner mechanisms.

Figure 15:
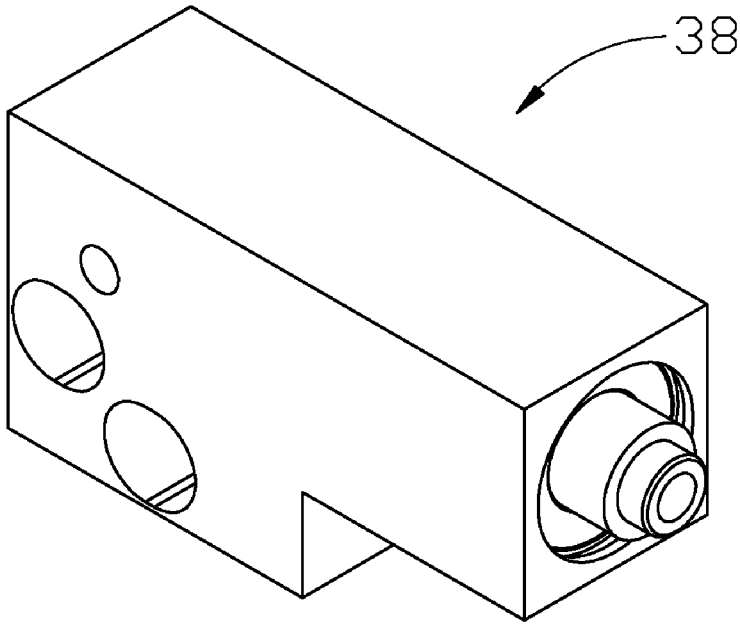
FIGS. 15, 16 are an axonometric view and a lateral section, respectively of a translating means for the needle support.
Figure 16:
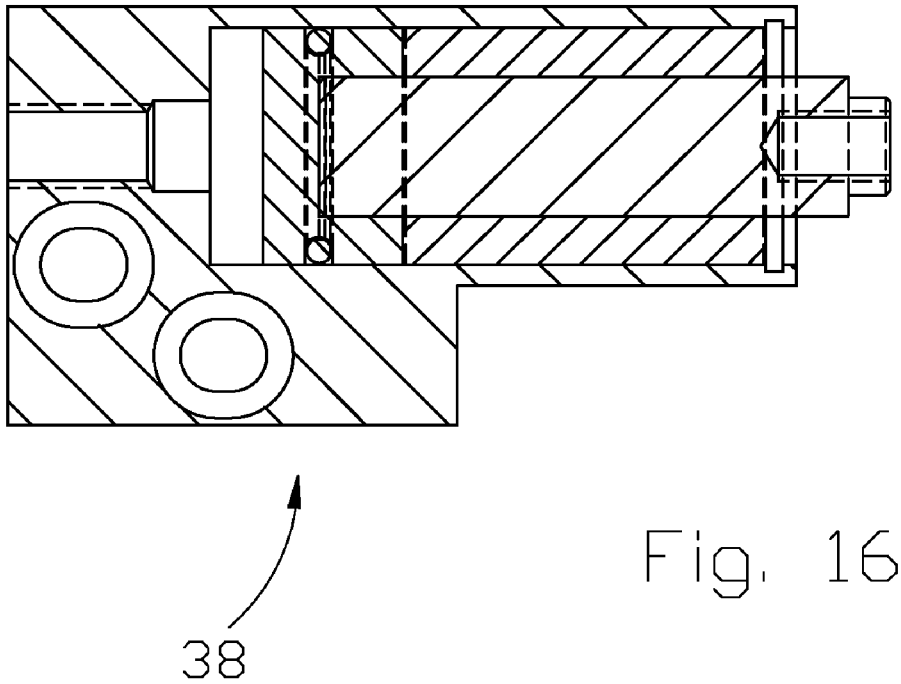

In particular, the translating means 38, 40 are pistons. One of the pistons is represented in detail in FIGS. 15,16.

Each piston 38, 40 moves the needle support 30 according to an only direction while the moving in the opposite direction is caused by springs 42, 44. In addition, said springs are to position the needle support 30 in a fixed position in case of absence of air in the pneumatic system of the pistons 38, 40.

The translation of the needle support 30 actuates, in synchronism, the selecting element 64 so that the suitable needle bar is put in motion as it can be seen in FIG. 9.

The selecting element 64 comprises a box element 65 on which screws 74, 76 are fixed at a certain distance.

In case one of the two pins 70, 72 of a bar is pressed, it releases the balls of the first group in order to release the same bar from the element 50, and presses the balls of the second group which cause a block on the guide support 52 and prevent the same bar from any vertical movement. On the contrary, when one of the pins 70, 72 is not pressed by the relative screw 74, 76, the balls of the first group, in the inside of the relative needle bar, are under pressure so that the same needle bar is fixed and firm to the connecting element 50 while the balls of the second group 45 are free and let the bar in question slide in respect to the guide support 52.

As it appears from FIG. 10, the distance between the two pins 70, 72 is different from the distance between the screws 74, 76. In this way, at a far end of the translation movement of the needle support 30, a pin 70 is pressed by the lower end of the screw 74 while the other pin 72 is not interested by any contact with the screw 76. Analogously, at the opposite far end of the translation, the pin 72 is pressed by the lower end of the screw 76 while the pin 70 is not subjected to any pressure since it is not in contact with the screw 74.

Figure 11:
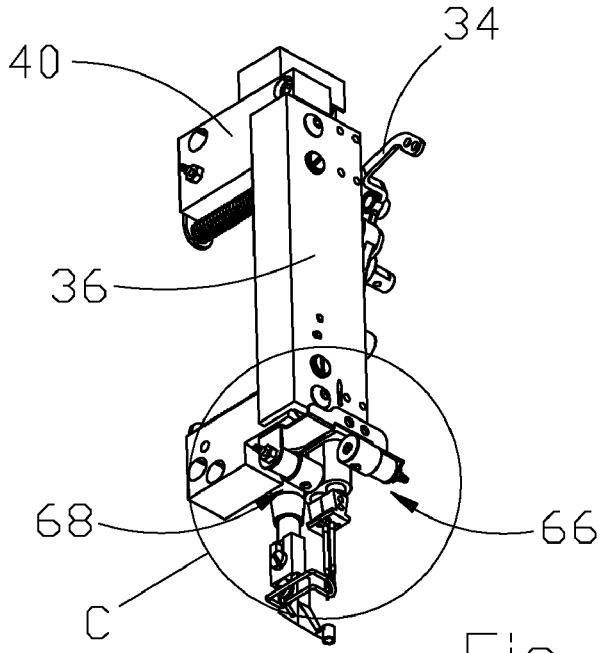
FIG. 11 is an axonometric bottom view of the needle support and relative translating means showing the thread locking means.
Figure 12:
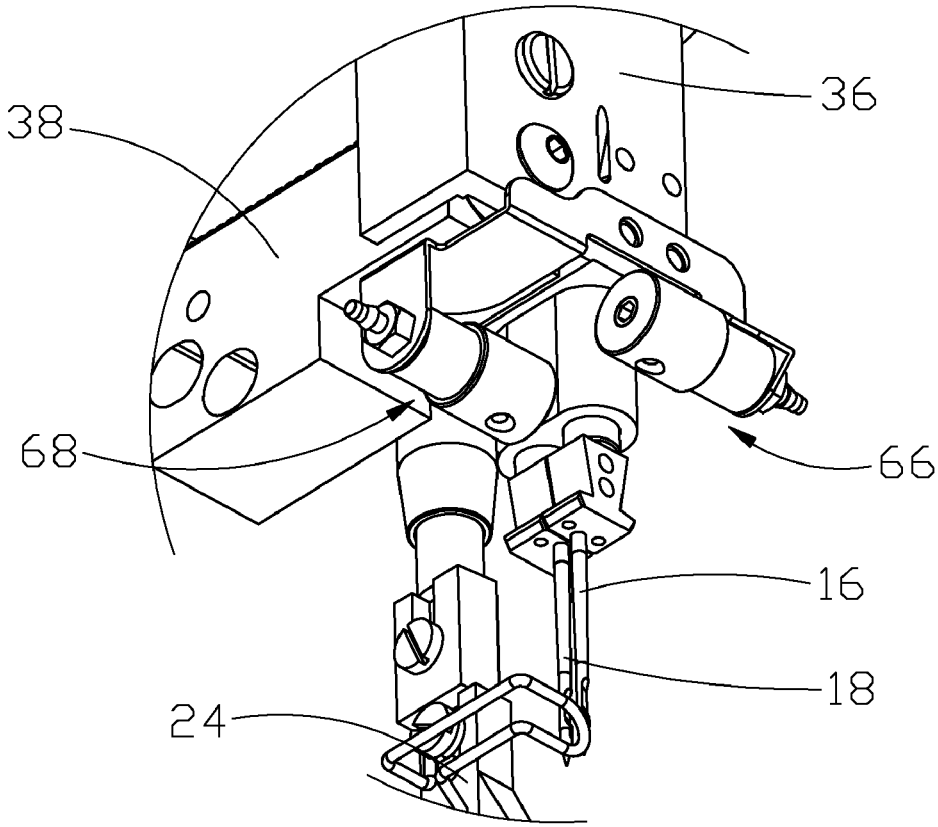
FIG. 12 shows a detail indicated with C in FIG. 11.

As it can be seen in FIGS. 3, 6, 7, 8, 9, the thread tension element 34 comprises two holes 33, 35 for the passing of a respective thread for each needle 16, 18. This means that both threads are moved even if the respective needle bar is locked. In order to avoid that the thread goes out of the needle eye, the machine 10 is provided with thread locking elements 66, 68, visible in FIGS. 11, 12, which can be operated selectively when the respective needle bar is stationary.

Figure 14:
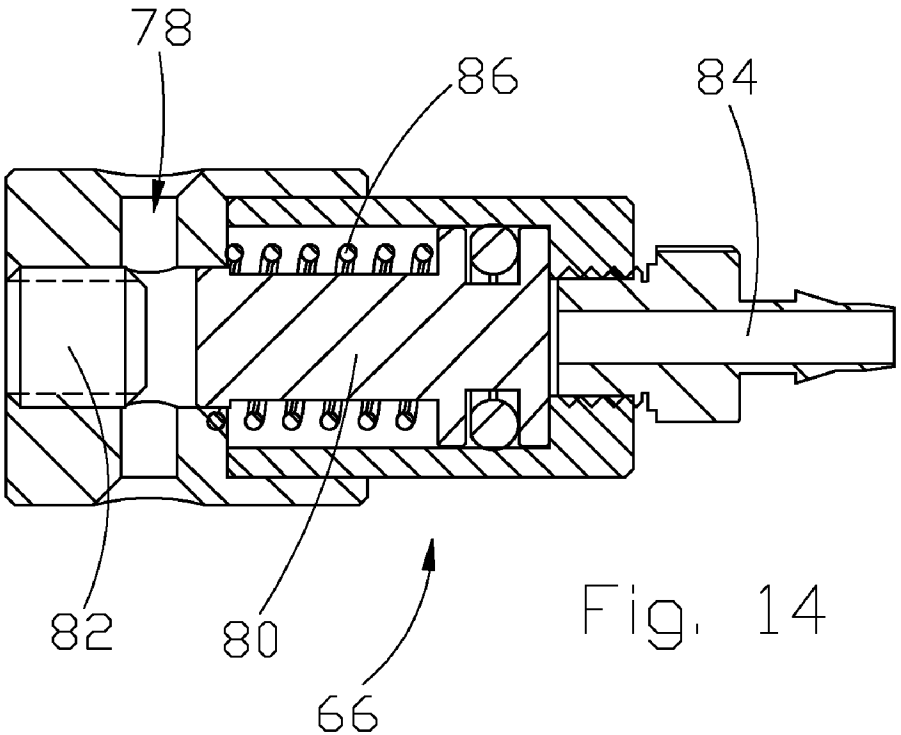
FIGS. 13, 14 are an axonometric view and a lateral section, respectively of a thread locking means.
Figure 13:
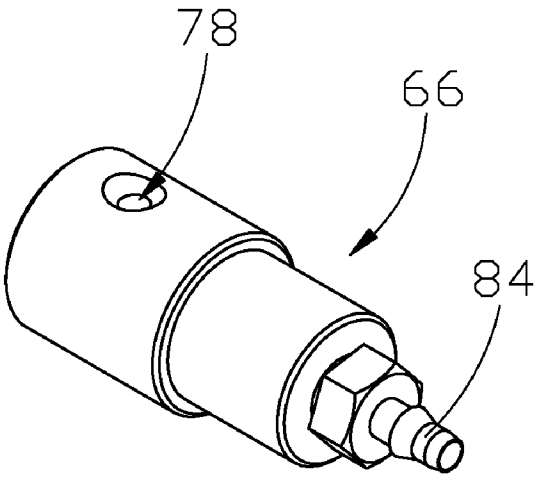

In FIGS. 13, 14, the thread locking element 66 is represented. It has a through-hole 78 through which the thread passes. In case, the thread can be locked. The inside of the thread locking element 66 comprises a pneumatically moveable piston 80. When the thread must be locked, air is fed from a nozzle 84 to the inner chamber of the thread locking element. The air moves the piston 80 that beats against a cap 82 provided at an end of the thread locking element 66. The thread is therefore locked between the head of the piston 80 and the cap 82. A spring 86 permits the return of the piston 80 to such a position that the thread can pass through the hole 78 again.

Naturally, the various mechanisms and devices of the so-described sewing machine are synchronized by a control central panel comprising pneumatic valves and electronic controls.

In this sewing machine it is possible to utilize a first thread showing particular characteristics to be coupled with a needle 16 and a second thread showing characteristics different from those of the first thread to be coupled with a needle 18. In case it is necessary to utilize the first thread, the needle support is translated in order to fix the connecting element 50 to the needle bar concerned and to let free the relative movement between the same element 50 and the other needle bar (fixed to the sewing machine). The thread locking element relative to the needle bar, which is stationary and integral to the sewing machine 10, is actuated in synchronism so that the thread is prevented from going out of the needle.

Analogously, in utilizing the other needle bar it is necessary to translate the needle support 30 through the pistons 38, 40 and/or the springs 42, 44 and to operate the ball locking mechanism that must lock, in a fixed position, a needle bar and to make movable the other needle bar with the connecting element 50.

According to a version of the invention, a sewing machine may comprise a needle support with three or more needle bars coupled with a connecting element permitting a vertical reciprocating motion. It is possible through suited selecting means to make an only needle bar integral with said connecting element, said needle bar being moved vertically along a crochet in order to effect a seam while the other needle bars remain fixed and integral with the sewing machine.

A technician of the sector may conceive modifications and variants that are to be considered as included in the scope of protection of this invention. For instance, instead of a selecting element 64 as described above it is possible to utilize an electromechanical means or other device that locks, selectively, the needle bar concerned in respect to the connecting element permitting the vertical reciprocating movement.

The invention claimed is:

1. Sewing machine comprising a base with a crochet and a head, the head comprising:

a needle support, a fabric pressure foot and its adjusting means, driving means to make a needle sew together with the crochet, lever means to turn the rotary motion of the driving means into vertical reciprocating motion, and wherein said needle support comprises:

at least two needle bars that are moved vertically by said lever means, a connecting element to couple the lever means to at least a needle bar, each one of said at least two needle bars being coupled to a needle provided with a respective thread and actuated selectively in the crochet in order to allow, translating means for translating said needle support in an orthogonal direction to the vertical movement of said at least two needle bars so that said needle support translates and brings one of said at least needle bars, which are operated selectively, to said crochet in order to allow sewing, and a selecting element for operating locking means that lock the connecting element to one of said at least two needle bars so that said one of said at least two needle bars moves vertically to allow a sewing operation while remaining needle bars of said at least two needle bars stand still and integral to the head of the machine.

2. Sewing machine according to claim 1, wherein the selecting element comprises actuating means which actuate locking means which in turn lock the connecting element to one of said at least two needle bars, the actuating means being operated through the translation of the needle support by means of the translating means.

3. Sewing machine according to claim 1, wherein thread locking means are comprised to let free the needle thread of said one of said at least two needle bars that is moved according to vertical reciprocating motion by the connecting element and to lock each needle thread of the remaining needle bars of said at least two needle bars that stand still and are integral to the head.

4. Sewing machine according to claim 1, wherein a thread tension element is comprised and put into motion by the lever means, holes being obtained in said thread tension element, the number of such holes corresponding to the number of said at least two needle bars so that each thread utilized by each needle of the respective needle bar passes through a respective hole.

5. Sewing machine according to claim 2, wherein each of said at least two needle bars comprises on its upper end a pin which, if pressed, presses a first group of balls adapted to couple each needle bar to the connecting element and it releases a second group of balls which allow the vertical movement of said each needle bar as to the needle support; if said pin is released, said pin releases the first group of balls, so that said pin releases each said needle bar from the connecting element and presses the second group of balls, so that said each needle bar is coupled to the needle support.

6. Sewing machine according to claim 5, wherein the selecting element comprises at least a screw adapted to press alternatively one of said pins.

7. Sewing machine according to claim 2, wherein thread locking means are comprised to let free the needle thread of said one of said at least two needle bars that is moved according to vertical reciprocating motion by the connecting element and to lock each needle thread of the remaining needle bars of said at least two needle bars that stand still and are integral to the head.

8. Sewing machine according to claim 2, wherein a thread tension element is comprised and put into motion by the lever means, holes being obtained in said thread tension element, the number of such holes corresponding to the number of said at least two needle bars so that each thread utilized by each needle of the respective needle bar passes through a respective hole.

9. Sewing machine comprising a base with a crochet and a head, the head comprising:

a needle support, a fabric pressure foot and its adjusting means, driving means to make a needle sew together with the crochet, lever means to turn the rotary motion of the driving means into vertical reciprocating motion, and wherein said needle support comprises:

at least two needle bars that are moved vertically by said lever means, a connecting element to couple the lever means to at least a needle bar, each one of said at least two needle bars being coupled to a needle provided with a respective thread and actuated selectively in the crochet in order to allow sewing, and thread locking means comprised to let free the needle thread of said one of said at least two needle bars that is moved according to vertical reciprocating motion by the connecting element and to lock each needle thread of remaining needle bars of said at least two needle bars that stand still and are integral to the head.

10. Sewing machine comprising a base with a crochet and a head, the head comprising:

a needle support, a fabric pressure foot and its adjusting means, driving means to make a needle sew together with the crochet, lever means to turn the rotary motion of the driving means into vertical reciprocating motion, and wherein said needle support comprises:

at least two needle bars that are moved vertically by said lever means, a connecting element to couple the lever means to at least a needle bar, each one of said at least two needle bars being coupled to a needle provided with a respective thread and actuated selectively in the crochet in order to allow sewing, and a thread tension element comprised and put into motion by the lever means, holes being obtained in said thread tension element, the number of such holes corresponding to the number of said at least two needle bars so that each thread utilized by each needle of the respective needle bar passes through a respective hole.

* * * * *